US006639970B1

(12) United States Patent
Kendall

(10) Patent No.: US 6,639,970 B1
(45) Date of Patent: Oct. 28, 2003

(54) LOW ANGLE HIGH SPEED IMAGE TUBE

(75) Inventor: Charles B. Kendall, Brookfield, WI (US)

(73) Assignee: GE Medical Systems Global Technology Co., LLC, Waukesha, WI (US)

( * ) Notice: Subject to any disclaimer, the term of this patent is extended or adjusted under 35 U.S.C. 154(b) by 0 days.

(21) Appl. No.: 10/065,390

(22) Filed: Oct. 11, 2002

(51) Int. Cl.[7] ..... H01J 35/00
(52) U.S. Cl. ..... 378/121; 378/119; 313/231.71
(58) Field of Search ..... 378/119, 121, 378/123, 125, 137, 140, 141, 143, 144; 313/231.71, 263.1, 359.1, 360.1, 362.1

(56) References Cited

U.S. PATENT DOCUMENTS 4,166,231 A * 8/1979 Braun ..... 313/60
4,894,852 A * 1/1990 Das Gupta ..... 378/119
6,341,157 B1 * 1/2002 Sakabe ..... 378/144
6,542,576 B2 * 4/2003 Mattson ..... 378/119

* cited by examiner

*Primary Examiner*—Drew A. Dunn
*Assistant Examiner*—Irakli Kiknadze
(74) *Attorney, Agent, or Firm*—Peter J. Vogel

(57) ABSTRACT

An imaging tube (51) is provided including a cathode (58) and an anode (60). The cathode (58) includes an emission surface (99), which emits a plurality of electrons along an emission axis (56). The anode (60) includes a body (76) having a track (58) on a peripheral section (78) of the body (76). The plurality of electrons are directed to impinge on the track (58) at an impingement angle $\alpha$ approximately equal to or between 15° and 25° relative to the emission axis (56) and are converted into x-rays. A method of generating x-rays within the imaging tube is also provided.

20 Claims, 3 Drawing Sheets

LOW ANGLE HIGH SPEED IMAGE TUBE

BACKGROUND OF INVENTION

The present invention relates generally to multi-slice computed tomography (CT) imaging systems, and more particularly, to an apparatus and method of generating x-rays within an imaging tube.

There is a continuous effort to increase computed tomography (CT) imaging system scanning capabilities. This is especially true in CT imaging systems. Customers desire the ability to perform longer scans at high power levels. The increase in scan time at high power levels allows physicians to gather CT images and constructions in a matter of seconds rather than several minutes as with previous CT imaging systems. Although the increase in imaging speed provides improved imaging capability, it causes new constraints and requirements for the functionality of the CT imaging systems.

Referring now to FIG. 1, a cross-sectional view of a traditional CT tube assembly 10 is shown. CT imaging systems include a gantry that rotates at various speeds in order to create a 360° image. The gantry contains the CT tube assembly 10, which composes a large portion of the rotating gantry mass. The CT tube assembly 10 generates x-rays across a vacuum gap 12 between a cathode 14 and an anode 16. In order to generate the x-rays, a large voltage potential is created across the vacuum gap 12 allowing electrons, in the form of an electron beam, to be emitted from the cathode 14 to a target 18 of the anode 16. In releasing of the electrons, a filament contained within the cathode 14 is heated to incandescence by passing an electric current therein. The electrons are accelerated by the high voltage potential and impinge on the target 18, whereby they are abruptly slowed down, directed at an impingement angle $\alpha$ of approximately 90°, to emit x-rays through CT tube window 19. The high voltage potential produces a large amount of thermal energy not only across the vacuum gap 12 but also in the anode 14.

The anode 14, as with other traditional style CT tube anodes, uses a store-now/dissipate-later approach to thermal management. In order to accommodate this approach the anode 14 is required to have a large mass and a large diameter target. The electron beam impacts the target 18, near a rim 20, essentially normal to the target face 22. The target 18 is rotated about a center axis 24 at approximately 180 Hz or 10,000 rpm to distribute load of the electron beam around a track region 26 of the target 18. Thermal energy generated in the track region 26 is transferred through the target 18 to a thermal storage material, such as graphite, which brazed to a back surface of the target 18. As the anode 14 rotates, thermal energy stored on the back surface of the target 18 dissipates during each revolution of the anode 14, thereby cooling the anode 14.

Traditionally, in order to increase performance of a CT imaging system, thereby increasing the amount and frequency of electron emission for a given duration of time, the diameter and mass of the target is increased. By increasing the diameter and mass of the target, thermal energy storage and radiating surface area of the target is increased for increased cooling.

Increasing the diameter and rotational speeds of the target is limited due to size, mass, and material strength of the target. The stated limitations in combination with a large amount of rotationally induced stress in the target, from instantaneous power being applied over very short durations on the target, also limit linear velocity of the track. Size of the target is also further limited by space constraints in a CT imaging system. An example of a space constraint, is the desire for good angulation capability, in that in cardiac or similar applications the CT system needs to be mobile and position flexible. Other space constraints exist and are commonly known in the art.

Additionally, faster scanning increases the mechanical loads on an entire CT tube, especially anode bearings, thus degrading CT tube component performance. Hence, in order to minimize mechanical loads the ability to increase the mass of the target is limited, which conflicts with the thermal performance of the X-ray tube. Faster scanning in increasing anode surfaces can cause subcooled nucleate boiling further decreasing scanning quality.

There is a continuous desire to perform CT scans at increased rates, thus requiring more instantaneous power to be applied on the target over very short durations potentially causing increased thermal energy. It would therefore be desirable to provide an apparatus and method of generating x-rays within an x-ray tube that provides increased scanning speed without increased thermal energy.

SUMMARY OF INVENTION

The present invention provides an apparatus and methods of converting electrons into x-rays within an imaging tube. An imaging tube is provided including a cathode and an anode. The cathode includes an emission surface, which emits a plurality of electrons along an emission axis. The anode includes a body having a track on a peripheral section of the body. The plurality of electrons are directed to impinge on the track at an impingement angle approximately equal to or between 15° and 25° relative to the emission axis and are converted into x-rays. A method of generating x-rays within the imaging tube is also provided.

One of several advantages of the present invention is that it provides an apparatus for emitting x-rays from an imaging tube with increased speed due to the ability to rotate the anode at increased speeds over traditional rotating anodes speeds.

Another advantage of the present invention is that due to mechanical and thermal operation of the imaging tube the present invention minimizes heat generated within the imaging tube as well as providing cooling of the anode while operating at the increased rotational speeds.

Furthermore, the present invention provides a smaller size anode, thus, reducing space requirements of the anode and increasing versatility as to application use of the imaging tube.

The present invention itself, together with attendant advantages, will be best understood by reference to the following detailed description, taken in conjunction with the accompanying figures.

BRIEF DESCRIPTION OF DRAWINGS

For a more complete understanding of this invention reference should now be had to the embodiments illustrated in greater detail in the accompanying figures and described below by way of examples of the invention wherein.

DETAILED DESCRIPTION

Figure 1:
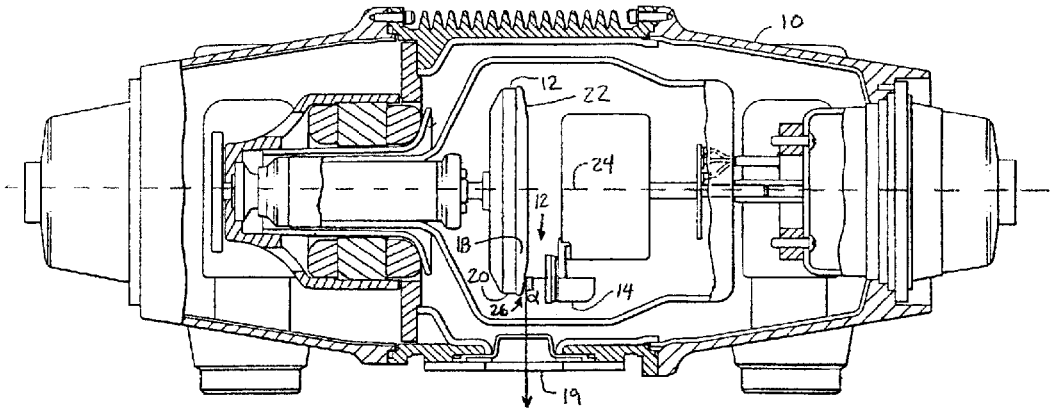
Fig. 1 (Prior Art)
FIG. 1, is a cross-sectional view of a traditional CT tube assembly.

In each of the following figures, the same reference numerals are used to refer to the same components. While the present invention is described with respect to apparatus and methods of generating x-rays within an imaging tube for a computed tomography (CT) imaging system, the following apparatus and method is capable of being adapted for various purposes and is not limited to the following applications: MRI systems, CT systems, radiotherapy systems, X-ray imaging systems, ultrasound systems, nuclear imaging systems, magnetic resonance spectroscopy systems, and other applications known in the art.

Also, the present invention although described as being used in conjunction with CT tube may be used in conjunction with other imaging tubes including x-ray tubes and camera tubes.

In the following description, various operating parameters and components are described for one constructed embodiment. These specific parameters and components are included as examples and are not meant to be limiting.

Figure 2:
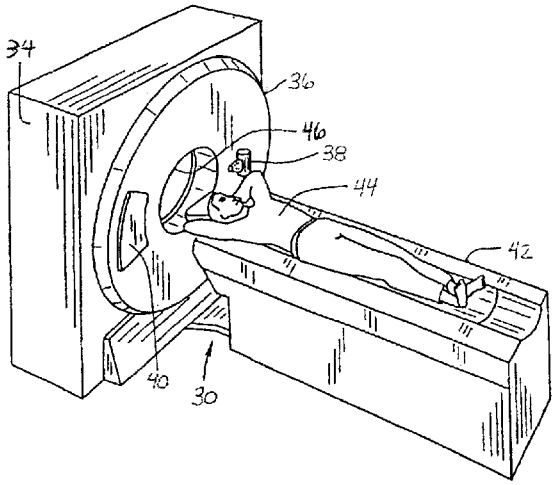
FIG. 2, is a perspective view of a CT imaging system including an imaging tube assembly in accordance with an embodiment of the present invention.

Referring now to FIG. 2, a perspective view of a CT imaging system 30 including an imaging tube assembly in accordance with an embodiment of the present invention is shown. The imaging system 30 includes a gantry 34 that has a rotating inner portion 36 containing a x-ray source 38 and a detector array 40. The x-ray source 38 projects a beam of x-rays towards the detector array 40. The source 38 and the detector array 40 rotate about an operably translatable table 42. The table 42 is translated along a z-axis between the source 38 and the detector 40 to perform a helical scan. The beam after passing through the medical patient 44, within a patient bore 46, is detected at the detector array 40 to generate projection data that is used to create a CT image.

Figure 3:
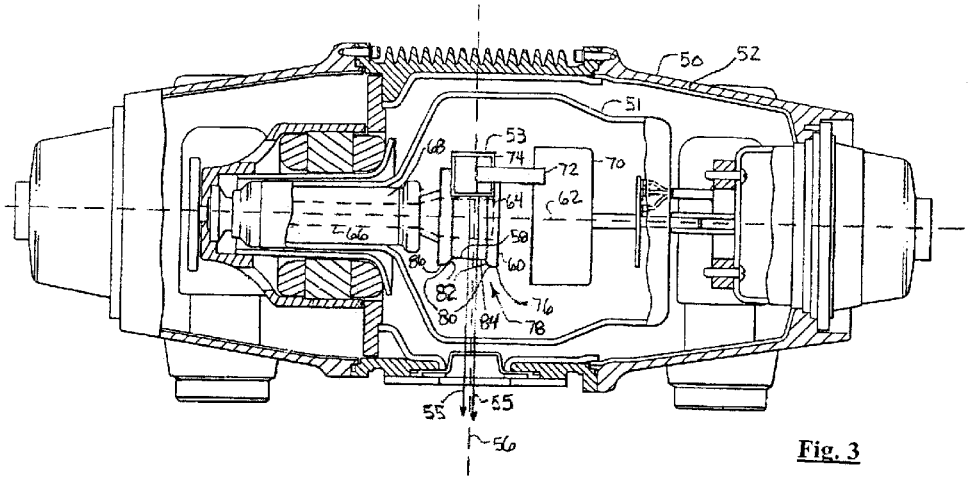
FIG. 3, is a cross-sectional front view of the imaging tube assembly in accordance with an embodiment of the present invention.
Figure 5:
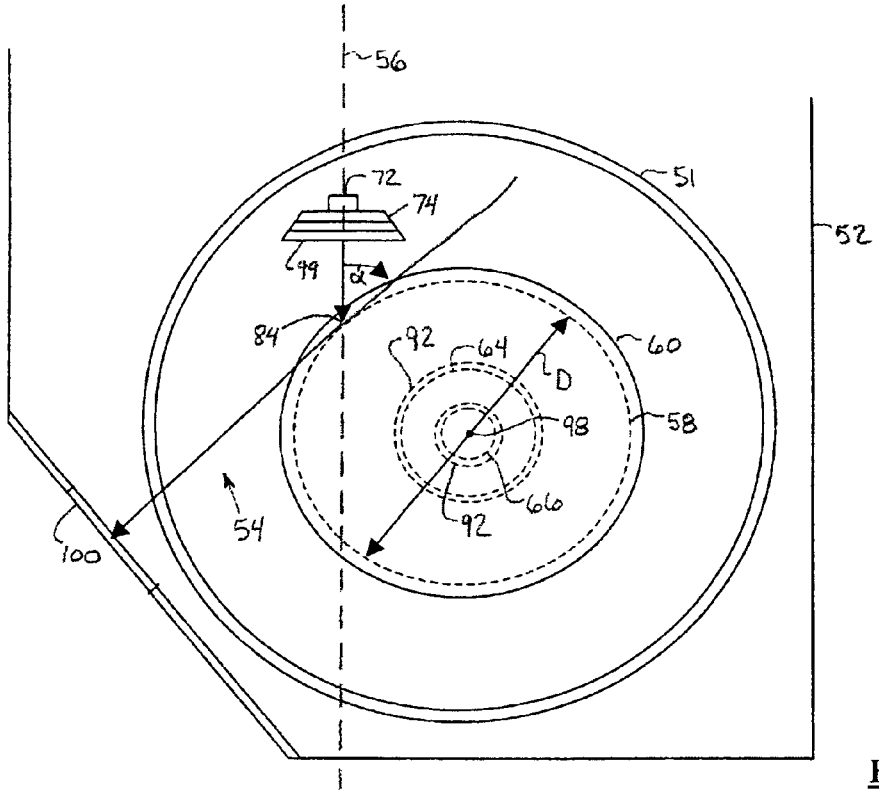
FIG. 5, is a cross-sectional side view of the imaging tube assembly illustrating electron beam emission and impingement angle in accordance with an embodiment of the present invention.

Referring now to FIG. 3, a cross-sectional front view of an imaging tube assembly 50 in accordance with an embodiment of the present invention is shown. The assembly 50 is located within the x-ray source 38 and includes an imaging tube 51, within a CT tube housing 52. A cathode 53 generates and emits electrons across a vacuum gap 54 in the form of an electron beam 55, which are directed along an emission axis 56 at a track 58 on a rotating anode 60. The vacuum gap is best seen in FIG. 5. The anode 60 rotates about a center axis 62 and is internally cooled via an inner thermal transient hub section 64 thermally coupled to an inner thermal transient core 66 within a shaft housing 68. The emission axis 56 is approximately perpendicular to the center axis 62.

The cathode 53 includes a base 70 mechanically coupled to an arm 72, which is mechanically coupled to a cathode emitter 74. The emitter 74 is oriented over the track 58, such that the electron beam 55 may be emitted along the emission axis 56. The emitter 74 may be oriented into various positions about the anode 60 in order to emit the electrons beam 55 in the direction of the track 58, accordingly. Electron beam emission is best illustrated in FIG. 5.

The anode 60 includes a body 76 having the track 58 on a peripheral section 78 of the body 76. The track 58 is defined by a pair of collared ends 80. The collared ends 80 have inner surfaces 82 that converge towards the emission axis 56 to a tangential impact surface 84, which is recessed from outer edges 86 of the pair of collared ends 80. The tangential impact surface 84 and the outer edges 86 are approximately parallel to the center axis 62.

Figure 4:
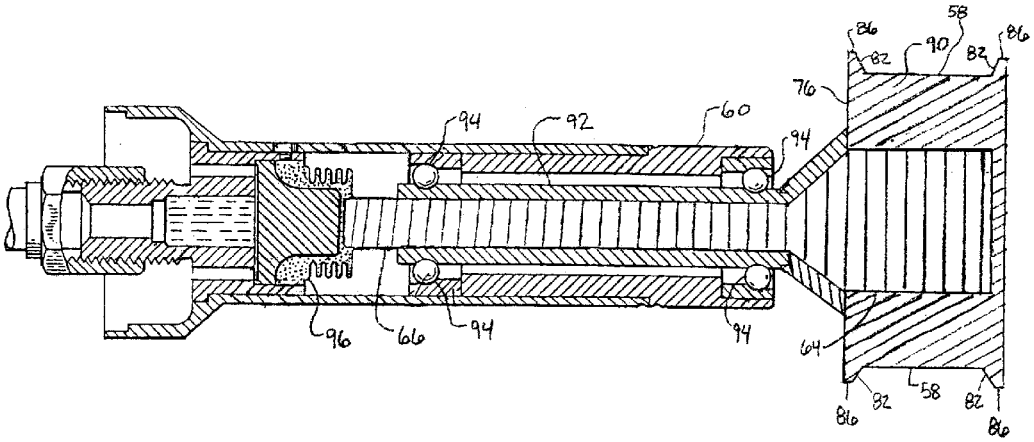
FIG. 4, is a cross-sectional side view of a rotating anode of the imaging tube assembly in accordance with an embodiment of the present invention.

Referring now to FIG. 4, a cross-sectional side view of the anode 60 in accordance with an embodiment of the present invention is shown. The anode 60 includes an outer hub section 90 and the inner hub section 64. A shaft 92 substantially contained within the shaft housing 68 is mechanically coupled to the outer hub section 90. The shaft 92 has a diverging section 93 that is not contained within the shaft housing 68 that diverges towards the hub section 90. The shaft 92 rotates on a set of bearings 94. The anode 60 as stated above is cooled via the inner hub section 64 and the core 66. The inner hub section 64 and the core 66 may be formed of copper, aluminum, or other thermal transient material known in the art. Thermal energy within the core 66 is absorbed by a metallic liquid radiator 96, where the thermal energy is then dissipated. The radiator 96 may be formed of gallium or similar metallic liquid known in the art.

The cooling of the anode via the inner hub section 64, the core 66, and the radiator 96 provides a dissipate-now approach to the thermal energy generated in the anode 60, in that the thermal energy is directly transferred across the inner hub section 64 and core 66 to the radiator 96 and dissipated.

Referring now to FIG. 5, a cross-sectional side view of the imaging tube assembly 50 illustrating emission of the electron beam 55 and impingement angle ox of the electron beam 55 in accordance with an embodiment of the present invention is shown. The cathode 53 is offset from a center point 98 of the anode 60. The cathode 53 emits the electron beam 55, from an emission surface 99 towards the tangential impact surface 84 at an impingement angle $\alpha$ of approximately equal to or between 15° and 25° relative to the emission axis 56. The emission surface 99 is approximately parallel to the tangential impact surface 84. The electron beam 55 upon impinging on the track 58 is converted into x-rays and directed through a CT tube window 100, in the CT tube housing 52 towards the detector array 40.

The thermal energy generated on the track 58 of the anode 60 is minimized due to the impingement angle $\alpha$. Electrons within the electron beam 55 are less directly impinging upon the anode 60 and therefore, are not generating as much thermal energy in the anode 60. Some of the electrons in the electron beam 55 may scatter or not follow along the emission axis 56 and are therefore not converted into x-rays. Electrons that are not converted into x-rays that traditionally bounce back to the anode 60 and generate additional heat in the anode 60, are bounced in the direction of the CT tube 51. The heat generated by the nonconverted electrons is cooled more quickly by the CT tube 51 over being cooled by the anode 60.

The anode 60 is also cooled via the hub 64, the core 66, and the radiator 96. Thus, the present invention not only minimizes the amount of heat generated in the anode 60 but also provides additional cooling for the anode 60. The ability to effectively cool the, anode 60 prevents degradation of internal componentry of the imaging tube assembly 50 overtime, including one such component of typical concern, the bearings 94. The increased ability to maintain the anode below a predetermined temperature allows the anode of the present invention to rotate at increased speeds, thereby, providing increased CT imaging scanning speeds.

Also, the anode 60 is capable of rotating at higher speeds of approximately 850 Hz or approximately equal to or between 20,000 rpm and 40,000 rpm, due to its reduced size and having a track diameter D of approximately equal to or between 35 mm and 75 mm, unlike diameters of conventional anodes, which are typically 240 mm. The present invention, contrary to teachings of prior art, provides a rotating anode having a smaller diameter that is capable of rotating at increased rotational speeds. A general understanding in prior art references is that in order to increase rotational speed the anode diameter needs to be increased for increased cooling and temperature maintenance of the anode.

Figure 6:
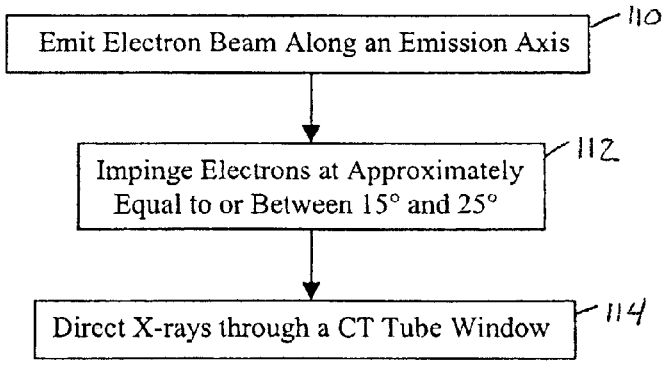
FIG. 6, is a logic flow diagram illustrating a method of generating x-rays within an imaging tube in accordance with an embodiment of the present invention.

Referring now to FIG. 6, a logic flow diagram illustrating a method of generating x-rays within an imaging tube 51 in accordance with an embodiment of the present invention is shown.

In step 110, the cathode 53 emits a plurality of electrons in the form of the electron beam 55 along the emission axis 56.

In step 112, the electrons are impinged upon the tangential impact surface 84 at an impingement angle $\alpha$ of approximately equal to or between 15° and 25° relative to the emission axis 56 to generate x-rays. During impingement of the electrons, the anode 60 may be rotated at approximately equal to or between 20,000 rpm and 40,000 rpm about the center axis 62.

In step 114, x-rays are generated and directed through the CT tube window 100.

Throughout steps 110–114 the anode 60 is being cooled by transferring thermal energy from the track 58 through the hub 64 and core 66 to the radiator 96.

The above-described steps are meant to be an illustrative example, the steps may be performed synchronously or in a different order depending upon the application.

The present invention provides an imaging tube with increased imaging speed capability due to increased rotational speed of the anode. The present invention, due to design constraints on electron beam emission and impingement angle minimizes the amount of heat generated in the anode. The present invention also provides a method of internally cooling the anode, thereby further increasing the potential rotational speed of the anode and potential imaging speed of a CT imaging system.

The above-described apparatus and manufacturing method, to one skilled in the art, is capable of being adapted for various purposes and is not limited to applications including MRI systems, CT systems, radiotherapy systems, X-ray imaging systems, ultrasound systems, nuclear imaging systems, magnetic resonance spectroscopy systems, and other applications known in the art. The above-described invention can also be varied without deviating from the true scope of the invention.

What is claimed is:

1. An imaging tube comprising:

a cathode comprising an emission surface emitting a plurality of electrons along an emission axis; and an anode comprising;

a body comprising a track on a peripheral section of said body;

wherein said plurality of electrons impinge on said track at an impingement angle approximately equal to or between 15° and 25° relative to said emission axis and convert into x-rays.

2. An imaging tube as in claim 1 wherein said body comprises an inner thermal transient hub section absorbing thermal energy from said body.

3. An imaging tube as in claim 1 wherein said track is defined by a pair of collared ends.

4. An imaging tube as in claim 3 wherein said track is recessed between said pair of collared ends.

5. An imaging tube as in claim 1 wherein said anode rotates at approximately equal to or between 20,000 rpm and 40,000 rpm.

6. An imaging tube as in claim 1 wherein said track has a diameter that is approximately equal to or between 35 mm and 75 mm.

7. An imaging tube as in claim 1 wherein a tangential impact surface of said track is approximately parallel to said emission surface.

8. An imaging tube as in claim 1 wherein a tangential impact surface of said track is approximately parallel to a center axis of said anode.

9. An imaging tube as in claim 1 further comprising:

an inner thermal transient hub section comprised within said body and absorbing thermal energy from said body;

a shaft mechanically coupled to said anode comprising;

an inner thermal transient core thermally coupled to said inner thermal hub section and absorbing thermal energy from said inner thermal transient hub section.

10. An imaging tube as in claim 1 wherein said inner thermal transient hub section and said inner thermal transient core are formed of a material selected from at least one of copper, aluminum, and a thermal transient material.

11. An imaging tube as in claim 1 wherein said inner thermal transient core is liquid cooled.

12. An imaging tube as in claim 11 wherein said liquid is a metallic liquid.

13. An imaging tube as in claim 11 wherein said liquid is at least partially contained gallium.

14. An imaging tube as in claim 1 wherein said emission axis is approximately perpendicular to a center axis of said anode.

15. A method of generating x-rays within an imaging tube comprising:

emitting a plurality of electrons from a cathode along an emission axis;

impinging said plurality of electrons on an anode at an impingement angle of approximately equal to or between 15° and 25° relative to said emission axis to generate x-rays; and directing said x-rays through an x-ray window.

16. A method as in claim 15 wherein impinging said plurality of electrons on an anode comprises rotating said anode at approximately equal to or between 20,000 rpm and 40,000 rpm.

17. A method as in claim 15 further comprising thermally transferring energy from an anode body to a cooling liquid.

18. An imaging tube comprising:

a cathode comprising an emission surface emitting a plurality of electrons along an emission axis; and an anode comprising;

a body comprising;

a track define by a pair of collared ends on a peripheral section of said body; and an inner thermal transient hub section thermally coupled to and absorbing thermal energy from said body;

wherein said plurality of electrons impinge on said track at an impingement angle approximately equal to or between 15° and 25° relative to said emission axis and convert into x-rays.

19. An imaging tube as in claim 18 wherein said track has a diameter that is approximately equal to or between 35 mm and 75 mm.

20. An imaging tube as in claim 18 wherein a tangential impact surface of said track is approximately parallel to said emission surface and to a center axis of said anode.

* * * * *